United States Patent [19]

Dion

[11] Patent Number: 5,069,108

[45] Date of Patent: Dec. 3, 1991

[54] BLASTING DEVICE FOR UNBLOCKING MINE RAISES

[76] Inventor: Serge Dion, 856 Boul D'Alembert, D'Alembert, Quebec,, Canada, J9X 5A3

[21] Appl. No.: 668,268

[22] Filed: Mar. 11, 1991

[30] Foreign Application Priority Data

Jul. 7; 1990 [CA] Canada ..... 2018540

[51] Int. Cl.[5] ..... F42D 3/04; F42B 3/00

[52] U.S. Cl. ..... 86/20.15; 89/1.34; 299/13

[58] Field of Search ..... 299/13; 175/2; 86/20.15; 89/1.34; 102/301, 375, 319, 504

[56] References Cited

U.S. PATENT DOCUMENTS

| | | | |
|---|---|---|---|
| 2,818,809 | 1/1958 | Roy | 86/20.15 |
| 3,541,797 | 11/1970 | Stewart | 86/20.15 |
| 3,770,523 | 11/1973 | Biswas | 86/20.15 |
| 4,036,099 | 7/1977 | French | 86/20.15 |
| 4,040,329 | 8/1977 | Ljungberg | 86/20.15 |
| 4,522,125 | 6/1985 | Marz | 299/13 |
| 5,007,345 | 4/1991 | Garr | 86/20.15 |

*Primary Examiner*—David H. Brown

*Attorney, Agent, or Firm*—Fleit, Jacobson, Cohn, Price, Holman & Stern

[57] ABSTRACT

A blasting device for unblocking ore passes, backfill raises, mine draw points and any other near vertical raises where rocks or other materials normally fall freely but may get blocked during use, comprises a propulsion unit including an air chamber mounted at the end of a hollow tube and having an inlet for receiving pressurized air and at least one outlet for allowing compressed air jets to exit downwardly from the air chamber to propel the propulsion unit upwardly, a reservoir mounted on the propulsion unit and adapted to hold explosive and an igniter, means for feeding pressurized air into the air chamber through the hollow tube, and an ignition line connected to the igniter for igniting the explosive from a distance.

3 Claims, 2 Drawing Sheets

BLASTING DEVICE FOR UNBLOCKING MINE RAISES

This invention relates to a blasting device for unblocking ore passes, backfill raises, mine draw points or any other near vertical raises, where rock or other material fall freely, but which may get blocked during use.

Ore passes, backfill raises, mine draw points or any other near vertical raises often get blocked during use and it is always a problem to unblock them as it is highly unsafe for a miner to work in the vicinity of and more particularly underneath a blockage area. It is common practice to unblock mine raises by attaching explosive sticks at the upper end of a string of poles, bracing the lower end of the string at the base of the raise and igniting the explosive to blast the rock blockage. However, working in the area immediately adjacent to the base of a raise is generally dangerous. Thus, some raises are never unblocked and this result in great losses in the mines.

It is the object of the present invention to provide a device for unblocking mine raises which presents a minimum of exposure for the miners.

The blasting device, in accordance with the present invention, comprises a propulsion unit including an air chamber mounted at the end of a hollow tube and having an inlet for receiving pressurized air and at least one outlet for allowing compressed air jets to exit downwardly from the air chamber to propel the propulsion unit upwardly, a reservoir mounted on the propulsion unit and adapted to hold explosive and an igniter, means for feeding pressurized air into the air chamber through the hollow tube, and an ignition line connected to the igniter for igniting the explosive.

A plurality of radial rods are preferably mounted circumferentially around the blasting device to keep sensitive points of the blasting device away from the walls of the raise and thus allow the device to raise freely along the walls of the raise.

A plurality of fins may be equally spaced around the tube to allow aiming of the device at a particular blockage point when such blockage is in a line of sight and movement of the blasting device towards the blockage point under the thrust of compressed air.

The invention will now be disclosed, by way of example, with reference to the accompanying drawings in which.

Figure 1:
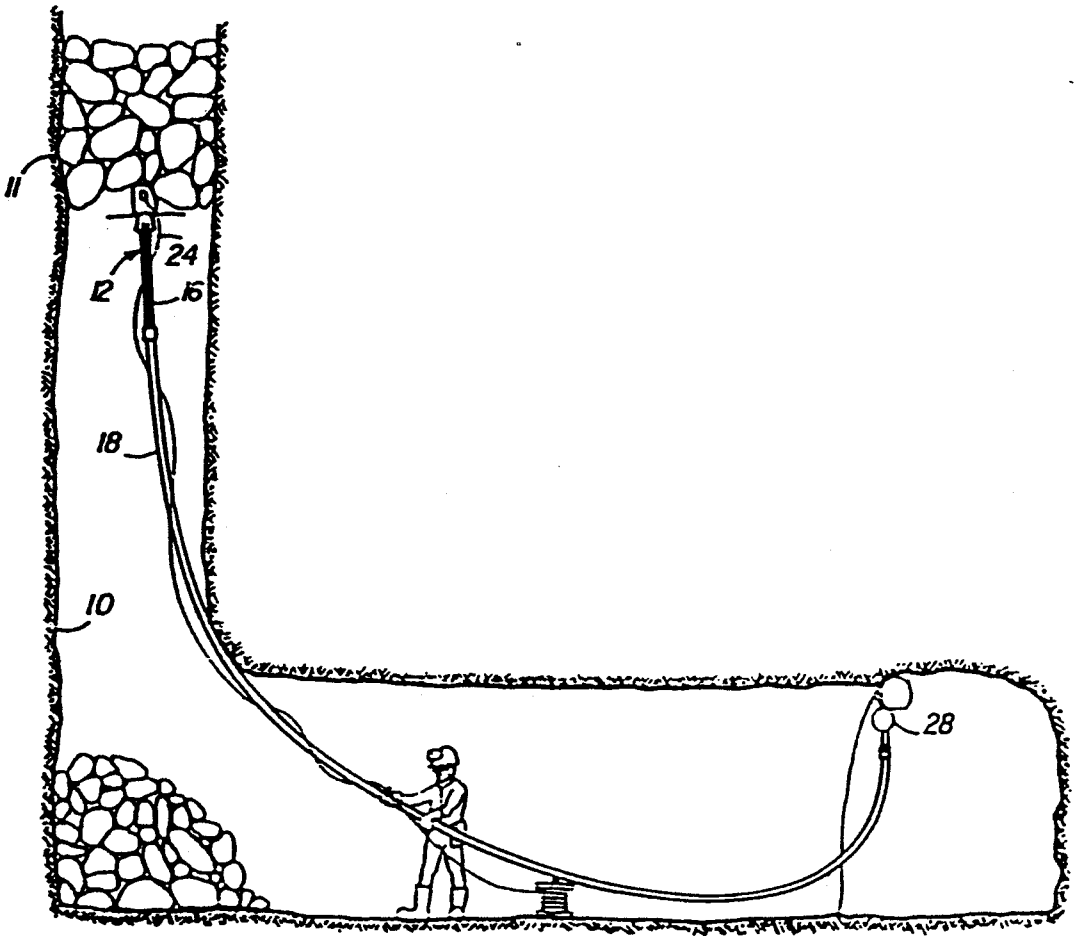
FIG. 1 is a diagram of a raise having a rock or other material blockage at an intermediate point.

Referring to FIG. 1, there is shown a diagram of a raise 10 having a rock blockage area at an intermediate point 11. To loosen the rocks, a blasting device designated generally by reference numeral 12 is allowed to climb up the walls of the raise under the thrust of compressed air generally provided in a mine and be blasted to free the rocks.

Figure 3:
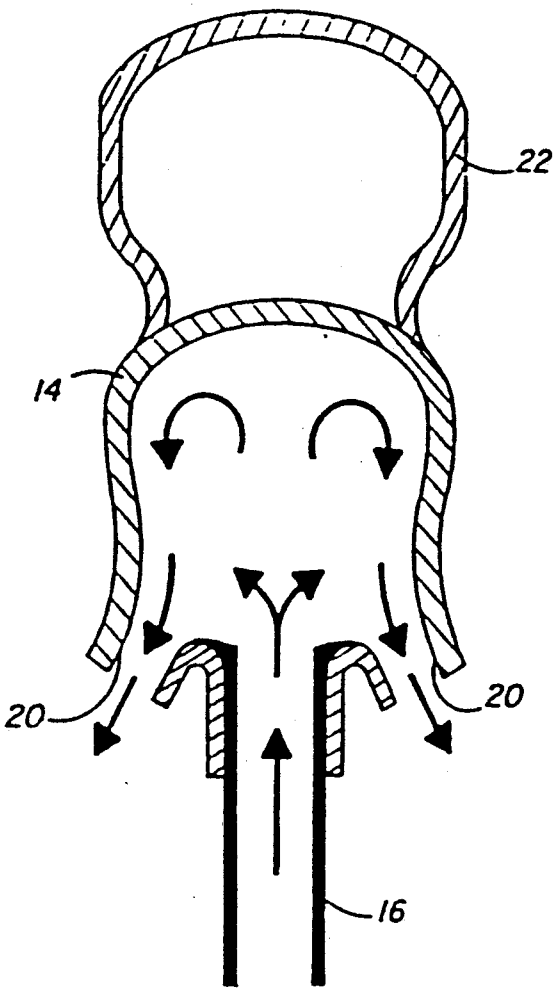
FIG. 3 is a section view of the blasting device of FIG. 1.
Figure 2:
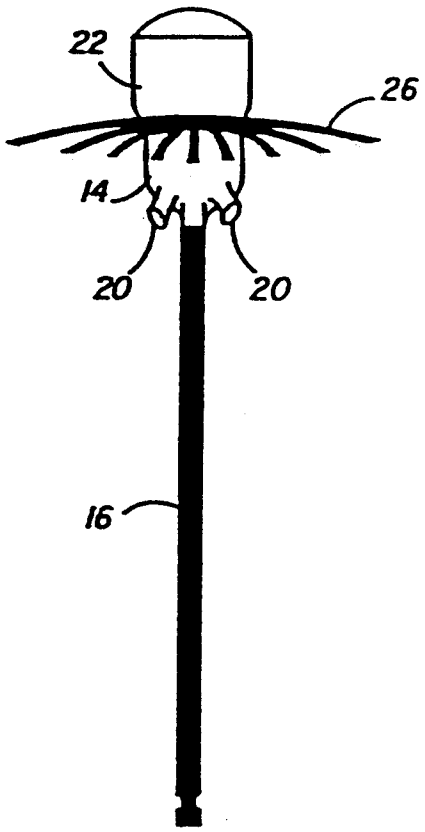
FIG. 2 is a side view of a blasting device in accordance with the present invention.

The blasting device is shown more clearly in FIGS. 2 and 3 and comprises a propulsion unit 14 comprising an air chamber mounted at the end of a hollow tube 16 which acts as a stabilizer and through which is fed compressed air from a hose 18 as shown in FIG. 1. The air chamber has a plurality of equally spaced air outlets 20 for allowing air jets to exit downwardly to provide an upward thrust to the propulsion unit. A reservoir 22 is mounted on the propulsion unit for containing explosive and a suitable igniter for the explosive. As shown in FIG. 1, an ignition line 24 is connected to the igniter and is allowed to hang down to the bottom of the raise for ignition when the blasting device is in place. A plurality of radial rods 26 made of non-conductive material are equally spaced around the circumference of the device to keep the blasting device away from the walls of the raise and thus allow the device to climb freely along the walls of the raise.

In operation, the hollow tube 16 of the blasting device is connected to the hose 18 and the hose is itself connected to a compressed air supply 28. Compressed air is fed through the hollow tube and the air jets from the outlets 20 of the propulsion unit exert an upward thrust to cause the unit to move up along the walls of the raise until it contacts the rock blockage. The ignition line is ignited and the explosive blasted to unblock the raise.

In order to allow the blasting device to raise under the regular 100 psi. air pressure normally provided in the mines, the blasting device is normally made of light but strong plastic materials which are commercially available.

Figure 4:
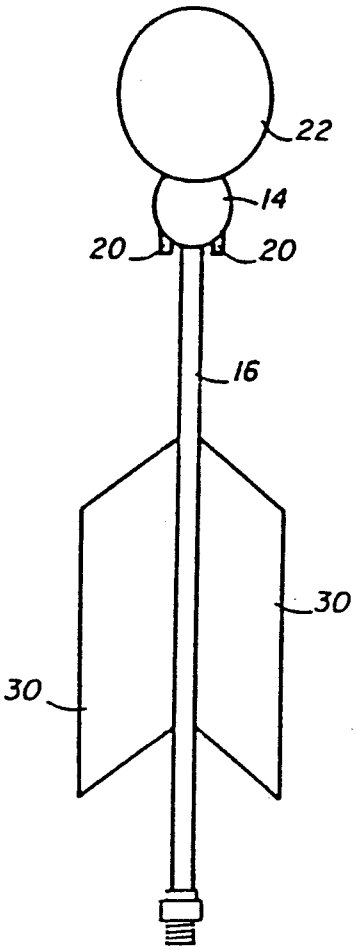
FIG. 4 is a view of an alternative embodiment of a blasting device in accordance with the present invention.

FIG. 4 illustrates an alternative embodiment of a blasting device similar to the one shown in FIG. 2 which is provided with equally spaced fins 30 around the hollow tube 16. This allows the device to be aimed at a particular blockage point when such point is in a line of sight. The blasting device then moves towards the target point under the propelling action of compressed air.

Although the invention has been disclosed with reference to a preferred embodiment, it is to be understood that it is not limited to such embodiment and that other alternative are also envisaged within the scope of the following claims.

I claim:

1. A blasting device for unblocking ore passes, backfill raises, mine draw points and any other near vertical raises where rocks or other materials normally fall freely but may get blocked during use, comprising:

a) a propulsion unit including an air chamber mounted at the end of a hollow tube and having an inlet for receiving pressurized air and at least one outlet for allowing compressed air jets to exit downwardly from said air chamber to propel the propulsion unit upwardly;

b) a reservoir mounted on said propulsion unit and adapted to hold explosive and an igniter;

c) means for feeding pressurized air into said air chamber through said hollow tube; and d) an ignition line connected to said igniter for igniting said explosive from a distance.

2. A blasting device as defined in claim 1, further comprising a plurality of radial rods mounted circumferentially on said blasting device to keep the blasting device away from the walls of the raise thus allowing the device to raise freely along the walls of the raise.

3. A blasting device as defined in claim 1, further comprising a plurality of fins equally spaced around said tube for allowing aiming of the device at a particular blockage point and movement of the blasting device towards the blockage point under the thrust of compressed air.

* * * * *